US007883448B2

(12) United States Patent
Wang

(10) Patent No.: US 7,883,448 B2
(45) Date of Patent: Feb. 8, 2011

(54) SIDE-SUPPORTING TYPE FOLDING MECHANISM FOR A TREADMILL

(76) Inventor: Leao Wang, No. 1, Lane 233, Sec. 2, Charng Long Road, Taiping (TW) 411

( * ) Notice: Subject to any disclaimer, the term of this patent is extended or adjusted under 35 U.S.C. 154(b) by 294 days.

(21) Appl. No.: 12/051,822

(22) Filed: Mar. 19, 2008

(65) Prior Publication Data

US 2009/0239716 A1 Sep. 24, 2009

(51) Int. Cl.
*A63B 22/02* (2006.01)

(52) U.S. Cl. ..... 482/54

(58) Field of Classification Search ..... 482/54, 482/51–52, 57

See application file for complete search history.

(56) References Cited

U.S. PATENT DOCUMENTS

| | | | | |
|---|---|---|---|---|
| 5,855,537 | A * | 1/1999 | Coody et al. | 482/54 |
| 5,868,648 | A * | 2/1999 | Coody et al. | 482/54 |
| 6,746,374 | B2 * | 6/2004 | Chang | 482/54 |
| 6,746,376 | B2 * | 6/2004 | Chang | 482/54 |
| 2004/0023758 | A1 * | 2/2004 | Chang | 482/54 |
| 2004/0087417 | A1 * | 5/2004 | Lo | 482/54 |
| 2007/0161467 | A1 * | 7/2007 | Lee | 482/57 |
| 2007/0191190 | A1 * | 8/2007 | Kuo | 482/54 |
| 2007/0238584 | A1 * | 10/2007 | Lee | 482/57 |
| 2008/0188358 | A1 * | 8/2008 | Kuo | 482/54 |
| 2009/0111665 | A1 * | 4/2009 | Wang | 482/54 |
| 2009/0176627 | A1 * | 7/2009 | Wang | 482/54 |

* cited by examiner

*Primary Examiner*—Rinaldi I Rada
*Assistant Examiner*—Robert F Long

(57) ABSTRACT

A side-supporting type folding mechanism for a treadmill having a rotating shaft pivotally disposed at the bottom of a base frame of the treadmill. Both sides of the rotating shaft are provided with a wing panel. The other end of the wing panel is supported by a pneumatic cylinder. Meanwhile, the center of the wing panel is pivotally connected with a top rod such that another end of the top rod pushes a rotating disc movable with the handrail. In addition, the center of the rotating shaft is connected with an auxiliary support having ground-touching rollers. Meanwhile, the pivot joints among the pneumatic cylinder, the wing panel and the top rod are disposed at a position of the same axle line. In this way, a potential great shear stress created between the supporting elements can be eliminated when the treadmill is folded in a folded position. Thus, the service life of the supporting elements can be extended.

3 Claims, 6 Drawing Sheets

SIDE-SUPPORTING TYPE FOLDING MECHANISM FOR A TREADMILL

BACKGROUND OF THE INVENTION

1. Fields of the Invention

The invention relates to a side-supporting type folding mechanism for a treadmill, and more particularly, to a treadmill in which pivot joints of supporting elements for the folding action are disposed at a position of the same axle line. In this way, a shear stress created in bearing the loading can be eliminated, thereby effectively extending the service life of the supporting elements.

2. Description of the Related Art

TW 585663 teaches a treadmill having a pneumatic cylinder at both sides of the bottom of the base frame thereof. Meanwhile, corresponding supporting elements are employed for facilitating the folding-up action of the base frame in a vertical storage position. However, we found that the pivot joints among the pneumatic cylinder, the auxiliary support and the coupling supporting rod for the supporting purpose are not in the same position of the axle line. Therefore, the pivot joint must be subject to a great shear stress in the field of mechanics of machinery when the supporting elements are loaded, especially when the base frame is folded-up in a vertical position. In other words, the supporting elements at their pivot joints must be loosened and shaken after a longer use. In a serious case, dangerous situations may happen and the pivot joints can be suddenly broken.

SUMMARY OF THE INVENTION

An object of the invention is to provide a side-supporting type folding mechanism for a treadmill that employs a better arrangement of the supporting elements such that the pivot joints among the supporting elements are disposed at a position of the same axle line. In this way, the shear stress at loading can be effectively reduced, thereby avoiding some potential dangerous situations.

According to the invention, a side-supporting type folding mechanism for a treadmill includes a rotating shaft pivotally disposed at the bottom of a base frame of the treadmill. Both sides of the rotating shaft are provided with a wing panel. The other end of the wing panel is supported by a pneumatic cylinder. Meanwhile, the center of the wing panel is pivotally connected with a top rod such that another end of the top rod pushes a rotating disc movable with the handrail. In addition, the center of the rotating shaft is connected with an auxiliary support having ground-touching rollers. Meanwhile, the pivot joints among the pneumatic cylinder, the wing panel and the top rod are disposed at a position of the same axle line.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
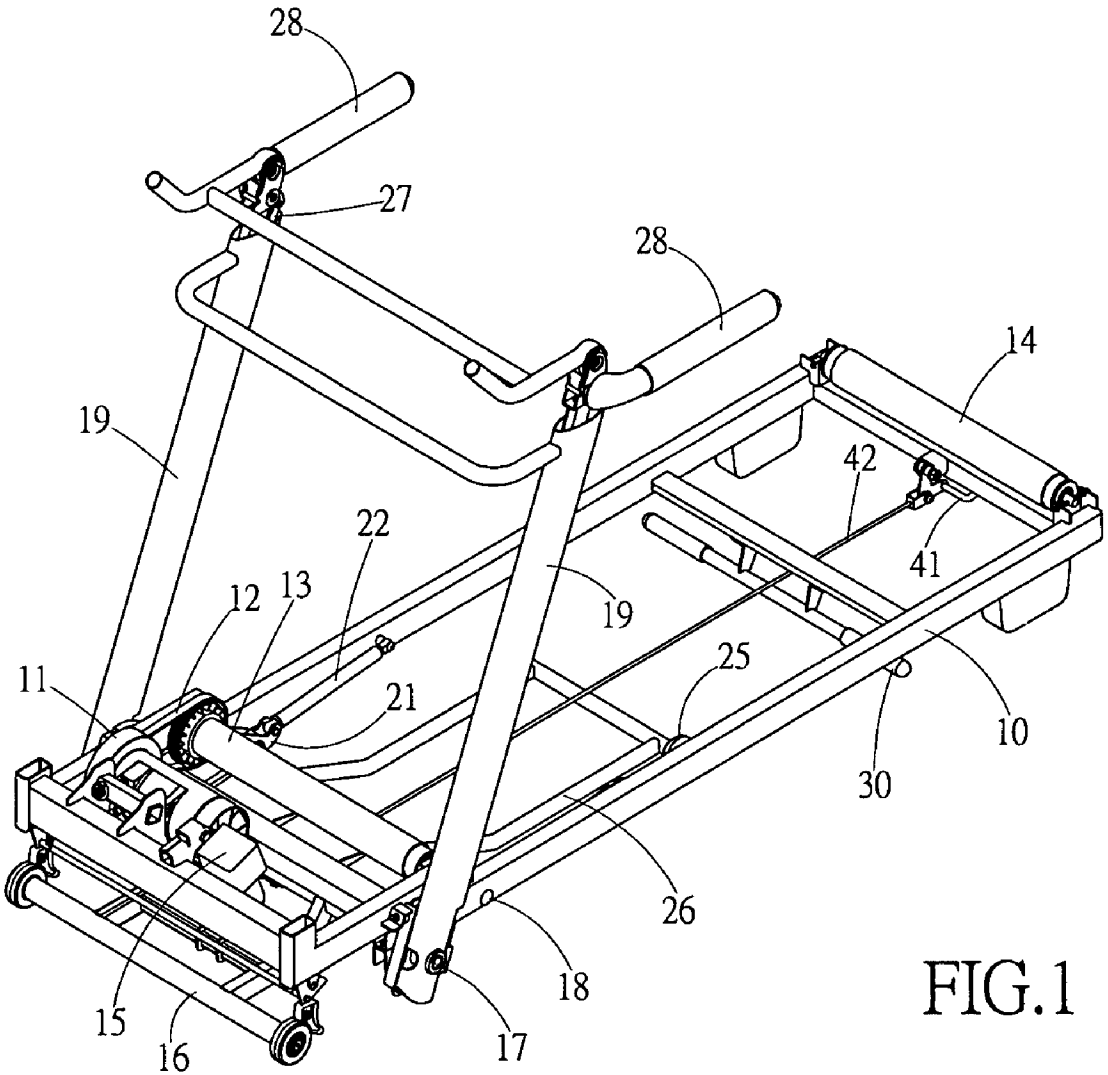
FIG. 1 is a perspective view of a preferred embodiment of the invention.
Figure 2:
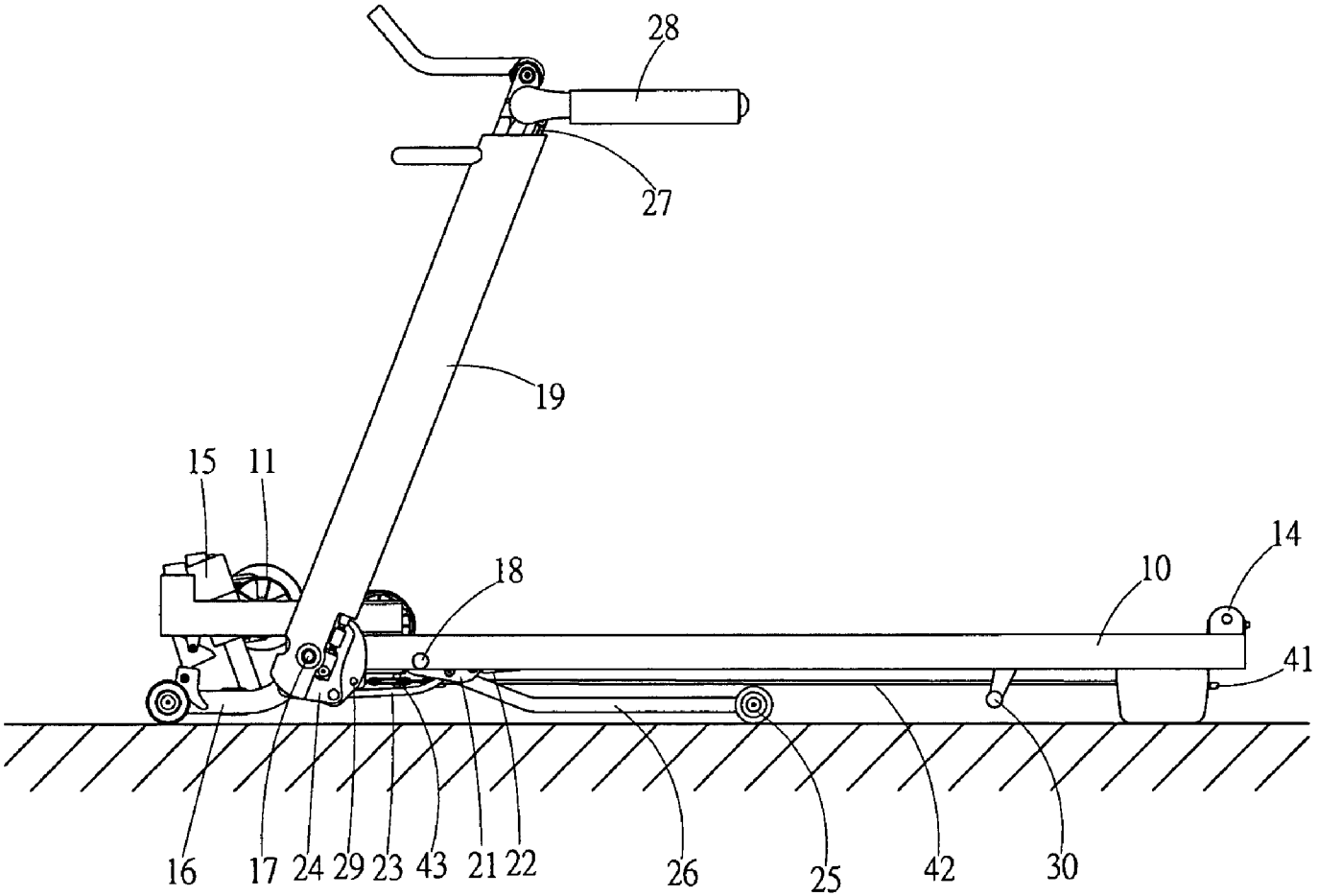
FIG. 2 is a side view of the embodiment of the invention according to FIG. 1.
Figure 3:
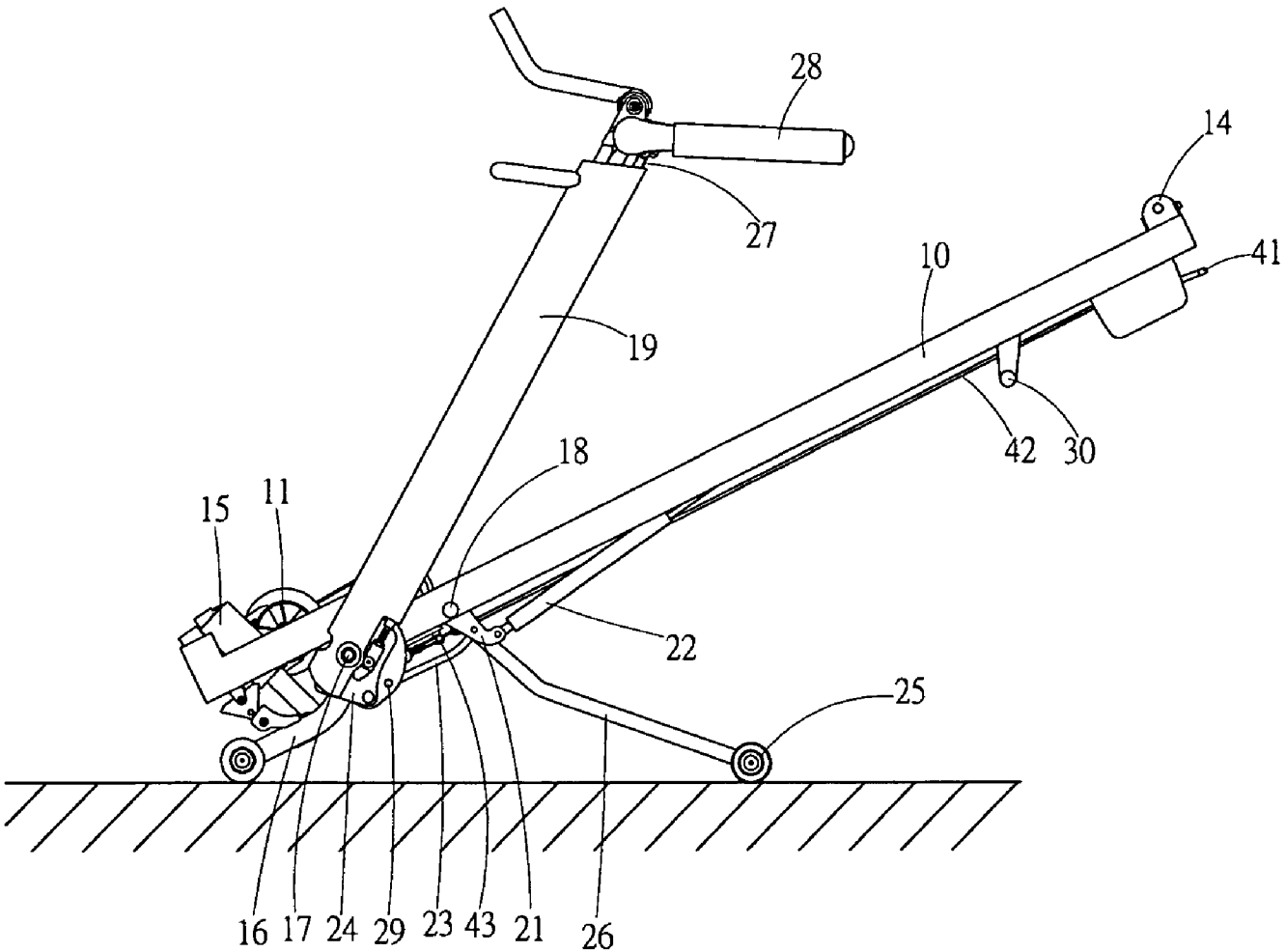
FIG. 3 is a schematic drawing of the action of the embodiment of the invention according to FIG. 1.
Figure 4:
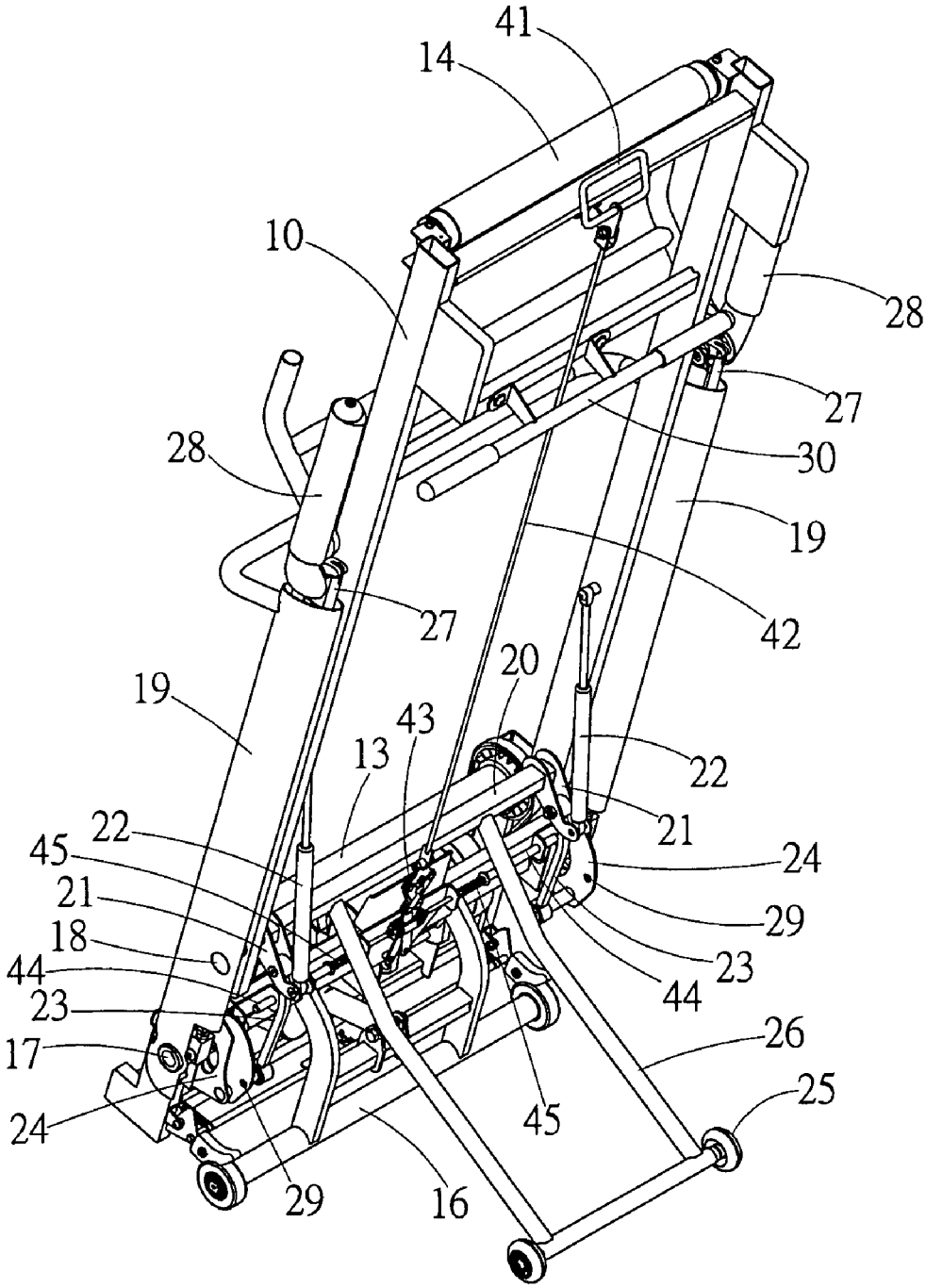
FIG. 4 is a perspective view of the embodiment of the invention according to FIG. 1 in a folded-up position.
Figure 5:
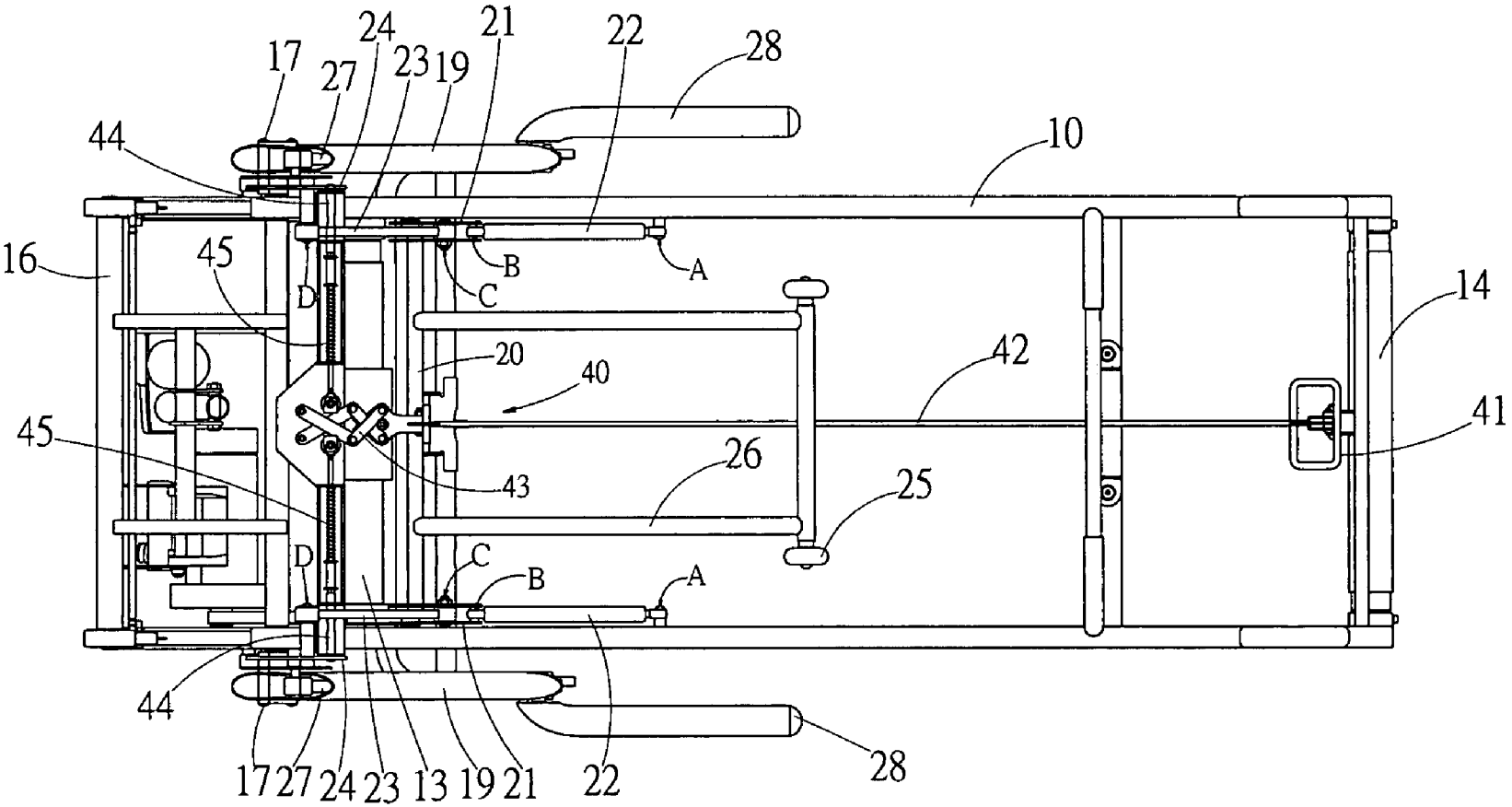
FIG. 5 is a bottom view of the embodiment of the invention according to FIG. 1.
Figure 6:
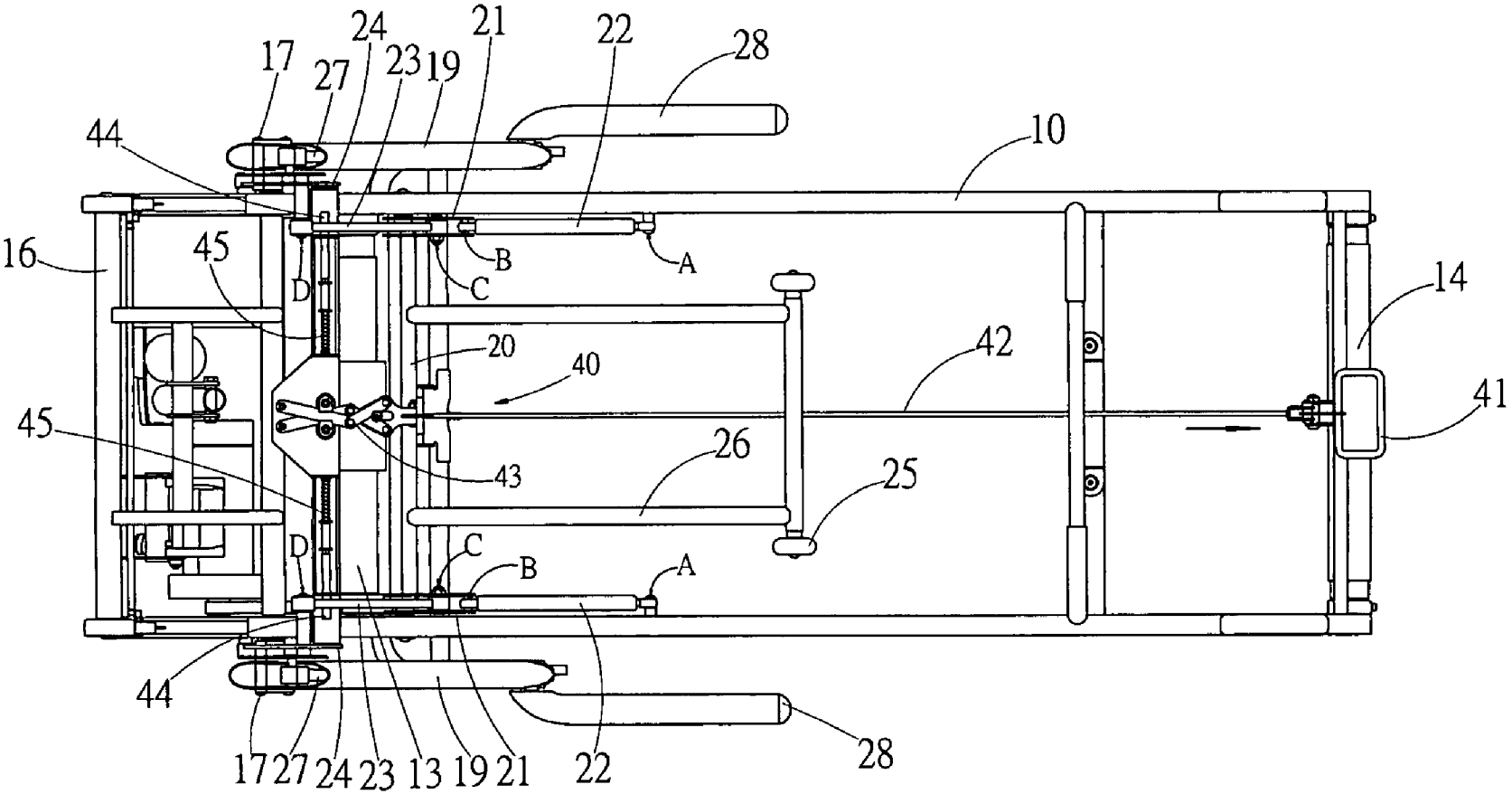
FIG. 6 is a schematic drawing of the action of the invention according to FIG. 5.

Referring to FIGS. 1 and 2, a transmission motor set 11 is disposed at one side of a base frame 11 in cooperation with a transmission belt 12, a front roller 13 and a rear roller 14 for rotating a continuous moving belt (not shown). Moreover, a lifting motor 15 is used for changing the vertical position of an adjusting support 16 to adjust the supporting inclination of the base frame 10. Besides, both sides of the base frame 10 are provided with two connecting pins 17, 18 for connecting a handrail 19 and a rotating shaft 20.

Referring to FIGS. 3 through 6, both sides of the rotating shaft 20 are provided with a wing panel 21. The other end of the wing panel 21 is supported by a pneumatic cylinder 22. Meanwhile, the center of the wing panel 21 is pivotally connected with a top rod 23 such that another end of the top rod 23 pushes a rotating disc 24 movable with the handrail 19. In addition, the center of the rotating shaft 20 is connected with an auxiliary support 26 having ground-touching rollers 25. Meanwhile, the pivot joints A, B, C, D among the pneumatic cylinder 22, the wing panel 21 and the top rod 23 are disposed at a position of the same axle line (see FIGS. 5 and 6). In this way, a potential great shear stress created between the supporting elements can be eliminated when the treadmill is folded in a folded position. Thus, the service life of the supporting elements can be extended.

Therefore, the pneumatic cylinder 22 is pushed by the weight of the base frame 10 into a compressed state when the base frame 10 is brought in an operational position. When the operator lifts the rear side of the base frame 10, the pneumatic cylinder 22 provides a proper auxiliary pushing force such that the wing panel 21 is rotated with the rotating shaft 20. In this way, the top rod 23 is pushed forward. At the same time, the rotating shaft 20 is rotated as well such that the auxiliary support 26 creates a synchronic rotation. Meanwhile, the auxiliary support 26 is in cooperation with the ground-touching rollers 25 to move in direction of the front end of the base frame 10 until the base frame 10 is brought in a stable vertical folded position.

When the operator pulls a lever 30 to move the base frame 10 downward, the ground-touching rollers 25 of the auxiliary support 26 are brought in a ground-touching and sliding position. Meanwhile, the cushioning effect created by the pneumatic cylinder 22 is utilized until the base frame 10 is moved downward in a horizontal position. In this way, a stable and effort-saving effect is achieved.

In fact, the handrail 19 will be moved in direction of the base frame 10 when the rotating disc 24 is pushed by the top rod 23. Meanwhile, a handle 28 can be simultaneously moved in direction of the base frame 10 by a coupling support rod 27 within the handrail 19.

In addition, a locking mechanism 40 in cooperation with locking holes 29 in the rotating disc 24 is employed for avoiding a false support action of the pneumatic cylinder 22 when the base frame 10 is in a horizontal position. In this way, an active locking effect is achieved. The locking mechanism 40 consists of a pull ring 41, a connecting rod 42, a cross type connecting rod 43, two lateral locking pins 44 and two springs 45. In brief, the pull ring 41 has to be pulled first such that two lateral locking pins 44 are detached from the rotating disc 24 to fold the base frame 10 in a storage position. When the base frame 10 is returned back to the horizontal position, the lateral locking pins 44 can be automatically locked into the locking holes 29 of the rotating disc 24 due to the resilience of the springs 45.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A side-supporting type folding mechanism for a treadmill, comprising:

a base frame;

a pivotable handrail located at a front end of the base frame;

a transmission motor set disposed at one side of the base frame;

a transmission belt in cooperation with the transmission motor;

a front roller and a rear roller for rotating a continuous moving belt;

a lifting motor at the front end of the base frame, the lifting motor being configured for changing the vertical position of an adjusting support to adjust the supporting inclination of the base frame;

a rotating shaft extending across the base frame and between two lower ends of the pivotable handrail;

two connecting pins located at both sides of the base frame, the two connecting pins being configured for connecting the pivotable handrail and the rotating shaft respectively;

two pneumatic cylinders, each pneumatic cylinder having one end attached to the base frame;

two wing panels, both sides of the rotating shaft being connected to a first end of each respective wing panel while the other end of each respective wing panel is pivotally connected to each respective pneumatic cylinder;

two top rods and two rotating discs, wherein a center of each wing panel is pivotally connected with a first end of each respective top rod such that another end of each top rod pushes each respective rotating disc, wherein each rotating disc is attached to an opposed side of the pivotable handrail so as to be pivotable with the pivotable handrail; and an auxiliary support having ground-touching rollers, wherein a center of the rotating shaft is connected with the auxiliary support having the ground-touching rollers, so that pivot joints among each pneumatic cylinder, each wing panel and each top rod are disposed at a position of a same axle line on respective sides of the side-supporting type folding mechanism.

2. The side-supporting type folding mechanism for a treadmill as recited in claim 1, wherein the handrail is moved in direction of the base frame when each respective rotating disc is pushed by each respective top rod, and wherein a handle is simultaneously moved in direction of the base frame by a coupling support rod within the handrail.

3. The side-supporting type folding mechanism for a treadmill as recited in claim 1, further comprising a locking mechanism in cooperation with locking holes in each respective rotating disc for achieving an active locking effect, wherein the locking mechanism consists of a pull ring, a connecting rod, a cross type connecting rod, two lateral locking pins and two springs.

* * * * *